US005495944A

United States Patent [19]

Lermer

[11] Patent Number: 5,495,944

[45] Date of Patent: Mar. 5, 1996

[54] BOTTLE WITH TAMPER EVIDENT WRAPPING

[75] Inventor: Stephen C. Lermer, Greenville, N.C.

[73] Assignee: Burroughs Wellcome Co., Research Triangle Park, N.C.

[21] Appl. No.: 323,400

[22] Filed: Oct. 14, 1994

[30] Foreign Application Priority Data

Oct. 21, 1993 [GB] United Kingdom ..... 9321755

[51] Int. Cl.[6] ..... B65B 5/43

[52] U.S. Cl. ..... 206/459.1; 206/497; 206/807; 215/251; 215/254

[58] Field of Search ..... 206/459.1, 459.5, 206/497, 807; 215/251, 254, 250

[56] References Cited

U.S. PATENT DOCUMENTS

| | | | |
|---|---|---|---|
| 3,272,367 | 9/1966 | Long | 215/251 |
| 4,236,646 | 12/1980 | Ganz, Jr. et al. . | |
| 4,246,307 | 1/1981 | Trautwein . | |
| 4,516,679 | 5/1985 | Simpson et al. . | |
| 4,537,309 | 8/1985 | Boorsma . | |
| 4,645,078 | 2/1987 | Reyner . | |
| 4,652,473 | 3/1987 | Han . | |
| 4,718,553 | 1/1988 | Adamoli et al. . | |
| 4,817,818 | 4/1989 | Lockhart . | |
| 4,840,281 | 6/1989 | Phillips et al. . | |
| 4,865,198 | 9/1989 | Butler . | |
| 4,876,123 | 10/1989 | Rivera et al. . | |
| 4,911,302 | 3/1990 | Butler . | |
| 4,931,327 | 6/1990 | Liu et al. . | |
| 4,972,953 | 11/1990 | Friedman et al. . | |
| 5,064,664 | 11/1991 | Hustad . | |
| 5,149,578 | 9/1992 | Wheatley et al. . | |
| 5,292,018 | 3/1994 | Travisano | 215/254 X |
| 5,310,261 | 5/1994 | Blue et al. | 206/807 X |

*Primary Examiner*—Jacob K. Ackun
*Attorney, Agent, or Firm*—Bell, Seltzer, Park & Gibson

[57] ABSTRACT

Disclosed herein is a sealed tamper-evident container. The container comprises: a bottle having a side wall portion and an open mouth portion; a cap connected to the bottle mouth portion; a frangible label connected to the bottle side wall portion; a wrapper having an upper portion that overlies the cap and a lower portion that overlies the bottle and at least a portion of the label so that the cap is sealably fixed to the bottle; and means for securing the wrapper lower portion with the frangible label. The wrapper upper portion is removable from the container and the cap so that the cap can be separated from the container. Removal of the wrapper lower portion ruptures the frangible label; the label rupture serves as a visible indicia of the removal of the wrapper bottom portion from the bottle, and thus alerts the consumer to possible tampering.

15 Claims, 3 Drawing Sheets

BOTTLE WITH TAMPER EVIDENT WRAPPING

FIELD OF THE INVENTION

This invention relates generally to tamper-evident packaging of substances, and more specifically relates to tamper-evident packaging utilizing a thin film that has been shrunk onto and thus encases the substance-bearing container.

BACKGROUND OF THE INVENTION

Recently, much public attention has been focused on the production of tamper-resistant and tamper-evident packaging, particularly in the packaging of pharmaceuticals, cosmetics, and food. Tamper-evident packaging alerts the consumer that the package has been tampered with and thus warns of the potential for danger if the product is used. Many regulations have been enacted in an attempt to ensure that any tampering with certain products will indeed be evident.

A particularly popular packaging method for pharmaceuticals and cosmetics is involves the encasing of a container in a thin polymeric film. Typically this process comprises shrinking a film balloon onto the container through the application of any or all of heat, pressure, and vacuum; having shrunk to encase the container, the film can seal and protect the encased components. Encasing films are easily and inexpensively applied to containers and, depending on the film employed, can impart airtight, watertight, aseptic or other desirable properties to the container.

A shortcoming of containers encased in polymeric film is that the film can be quite easily removed from the container and replaced with a second film; thus one tampering with the container can remove the outer film, tamper with the contents of the container, and encase the container with a new film that is indistinguishable from the original to the consumer. Therefore a tamper-evident container encased in a thin film must provide indicia of tampering responsive to removal of the film from the container. This problem has been addressed in a number of different ways. For example, the film itself may comprise multiple layers which respond to rupture or some other disturbance by displaying indicia of tampering. See, e.g., U.S. Pat. No. 4,876,123 to Rivera et al.; U.S. Pat. No. 4,246,307 to Trautwein; U.S. Pat. No. 4,652,473 to Han. Others have disclosed packaging in which the encasing wrap lifts ink from the container upon its removal, thereby indicating tampering. See, e,g., U.S. Pat. No. 4,718,553 to Adamoli et al.; U.S. Pat. No. 4,972,953 to Friedman et al. Each of these methods can be rather expensive, so researchers are continually investigating new tamper-evident products and methods.

SUMMARY OF THE INVENTION

The present invention provides as a first aspect a sealed tamper-evident container. The container comprises: a bottle having a side wall portion and an open mouth portion; a cap connected to the bottle mouth portion; a frangible label connected to the bottle side wall portion; a wrapper having an upper portion that overlies the cap and a lower portion that overlies the bottle and at least a portion of the label so that the cap is sealably fixed to the bottle; and means for securing the wrapper lower portion with the frangible label. The wrapper upper portion is removable from the container and the cap so that the cap can be separated from the container. Removal of the wrapper lower portion ruptures the frangible label; the label rupture serves as a visible indicia of the removal of the wrapper bottom portion from the bottle, and thus alerts the consumer to possible tampering. Preferably, the label is connected to the wrapper lower portion by an adhesive layer which is formed into a pattern of indicia of warning; rupture of the label renders the indicia of warning visible to the consumer.

DETAILED DESCRIPTION OF PREFERRED EMBODIMENT

Figure 1:
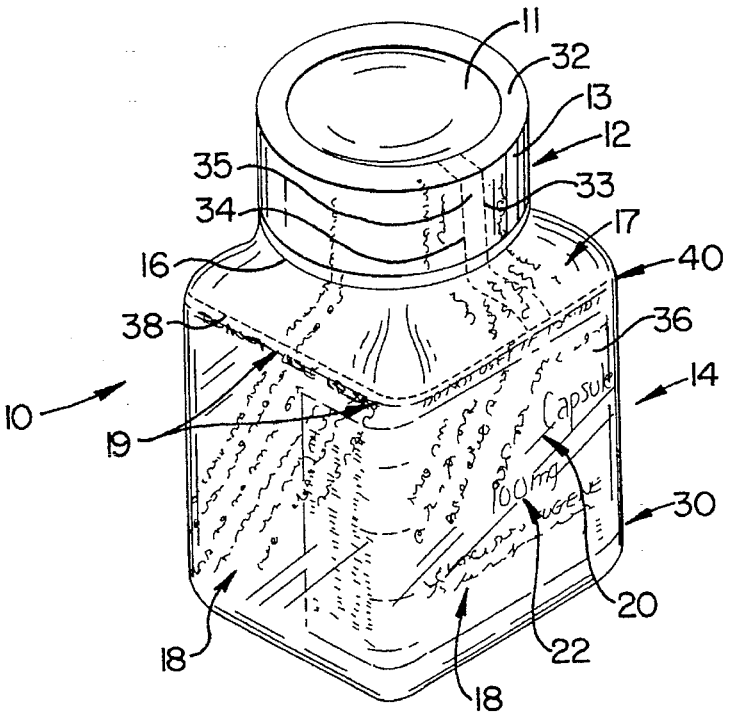
FIG. 1 is a perspective view of an unopened container encased in film.

Referring now to the drawings, FIG. 1 shows a container, illustrated broadly at 10, comprising a bottle 14 and a mating cap 12 encased in a wrapper 30. The bottle 14 comprises vertical walls 18, a cylindrical mouth portion 16 configured to mate with the cap 12, and a transitional shoulder portion 17 connecting the upper edge portions 19 of the vertical walls 18 to the lower end of the mouth portion 16. The mouth portion circumscribes at its upper end an aperture (not shown) that provides access to the interior cavity of the bottle 14, which is defined by the vertical walls 18, the shoulder portion 17, and a floor (not shown) connected to the lower edges of the vertical walls. Those skilled in this art will appreciate that the vertical walls shoulder portion 17, and mouth portion 16 can take a number of configurations to provide a bottle having a desired shape differing from that illustrated herein; these structures can be configured so that the footprint of the bottle is substantially square, rectangular, circular, oval, triangular, or any other polygonal shape, and still be suitable for use with this invention.

The cap 12, which comprises a top surface abutting the upper end of a cylindrical surface 13, is configured to removably mate with the mouth portion 16 of the bottle 14. Many mating cap and mouth configurations are known; exemplary are a set of mating threads on the inner surface of the cylindrical surface 13 and on the outer surface of the mouth portion 16 and a pressure-fit cap-mouth combination. Optionally, the cap and mouth configuration are such that they are of a configuration known in the art as "child-resistant."

A frangible label 20 is connected by its inner surface 23 to one or more of the vertical walls 18 of the bottle 14. The label 20 optionally includes copy which can identify the contents of the bottle 14 and can also warn the user of the possibility of tampering if the label is ruptured by removal of the wrapper 30 from the bottle 14. It is preferred that the label be adhered to a vertical wall 18 with a permanent adhesive, so that any attempt to remove the label 20 from the vertical walls will leave behind evidence of the label's prior existence, thereby alerting the consumer to the possibility of tampering.

Figure 4:
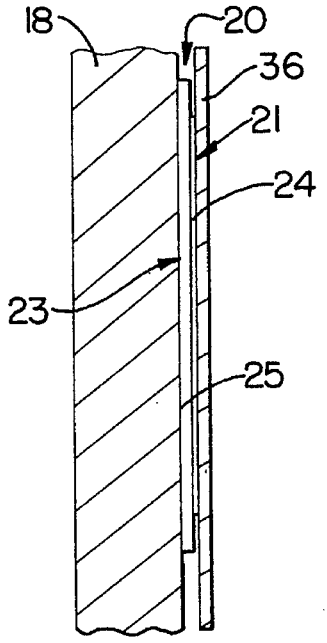
FIG. 4 is a cross-sectional view of the side wall portion of an unopened film-encased container showing the container, label, adhesive, and wrapper layers.

The label 20 can be formed of any material that is sufficiently frangible to rupture when a mild shear stress is applied to its top surface 21 (FIG. 4). The label 20 preferably is formed of a material having a smooth top surface 21 and a fibrous inner portion 25. In such a configuration, the top surface 21 is ruptured by removal of the wrapper 30, thereby exposing the inner surface and providing a tampering warning; this configuration is particularly effective if the top surface 21 is visually distinct in color or texture from the inner surface. It is preferred that the top surface 21 be free of the varnish typically applied to labels of this sort, as the presence of varnish may interfere with the connection between the wrapper 30 and the label 20.

Figure 5:
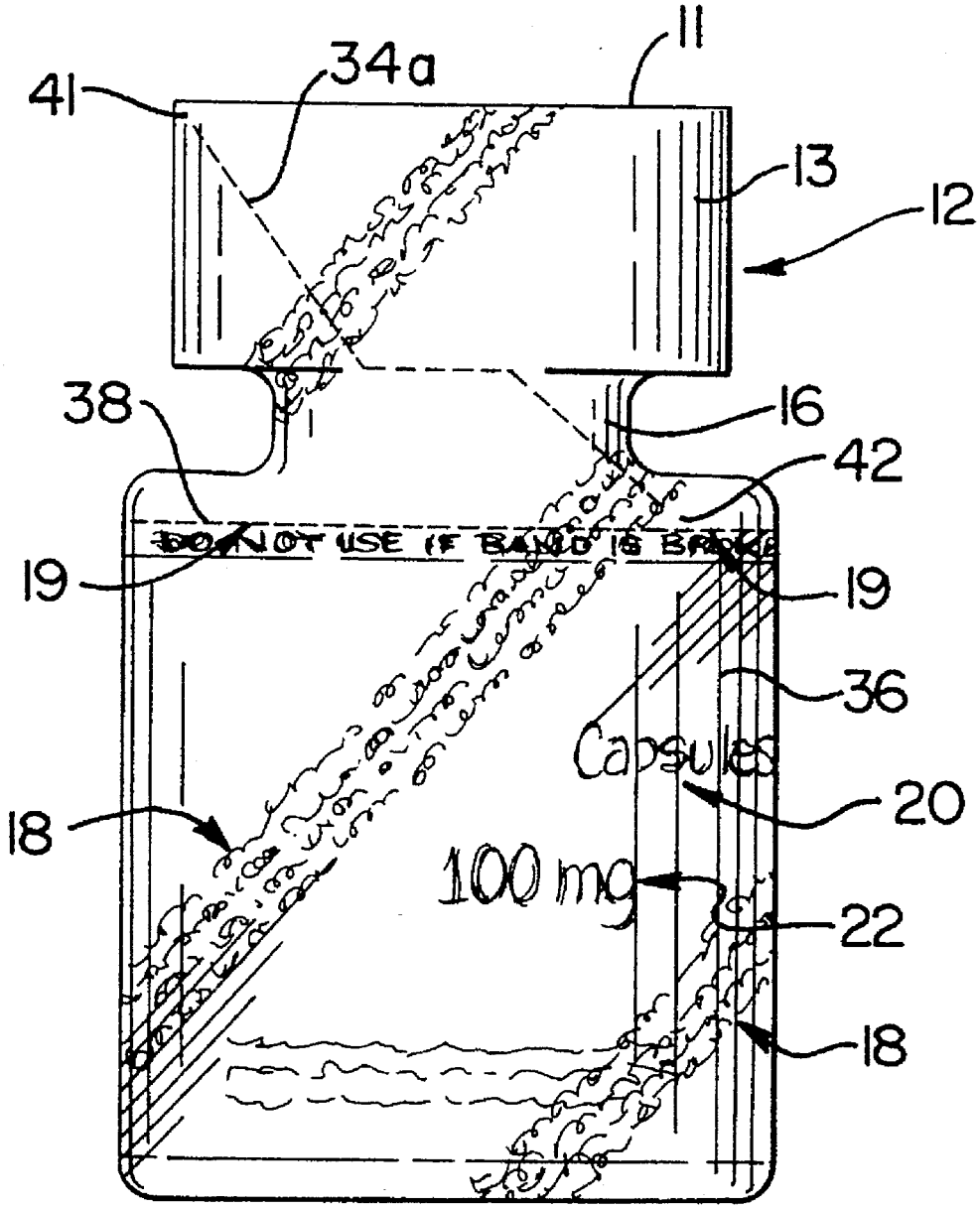
FIG. 5 is a front view of an unopened container encased in film with a series of diagonal perforations for removing the upper portion of the wrapper.

The wrapper 30 comprises an upper portion 32 which overlies the cap 12 and shoulder portion 17 and a lower portion 36 that overlies the vertical walls 18 of the bottle 14. An aligned set of latitudinal perforations 38 separates the wrapper upper portion 32 and the wrapper lower portion 36; the perforations overlie and encircle the upper edge portions 19 of the vertical walls 18. The wrapper upper portion 32 includes a pair of vertical perforations 33, 34, each of which extends from the portion of the wrapper upper portion 32 that overlies the top surface 11 of the cap 12 to the set of latitudinal perforations 38. The vertical perforations 33, 34 and the latitudinal perforations 38 define therewithin a frangible tab 35. Although the illustrated configuration for the wrapper 30 is preferred, those skilled in this art will appreciate that any wrapper having an upper portion that sealably fixes the cap 12 to the mouth portion 16 of the bottle 14 and a lower portion that overlies at least a portion of the label 20, and that permits separation of the cap 12 from the bottle 14, is suitable for use with the present invention. For example, (FIG. 5) shows another embodiment where the wrapper upper portion 32 includes a series of diagonal perforations 34*a* which extend from a location 41 approximately one-eighth inch (⅛") below the portion of the wrapper upper portion 32 that overlies the top surface 11 of the cap 12 to a location 42 one-eighth inch (⅛") above the set of latitudinal perforations 38. The application of torque to the cap results in the upper portion of the wrapper spiraling in a spring-like action away from the cap.

It should be understood that the present invention encompasses not only wrapper configurations in which the wrapper upper portion 32 is completely removed from the wrapper lower portion 36 prior to the removal of the cap 12 from the bottle 14, but also encompasses configurations in which a seam or other fracture forms in the wrapper 30 that enables the cap 12 to be removed. Also, the wrapper 30 preferably includes warning text 40, illustrated herein to abut the upper edge of the wrapper lower portion 36, to alert the consumer that a container 10 having its wrapper upper portion 32 removed prior to acquisition by the consumer should be treated as tampered with and thus discarded.

The wrapper 30 is typically formed of a thin polymeric film. The film comprising the material should be capable of encasing all or a portion of the container 10 by some treatment method, such as heat shrinking or pressure forming. Exemplary materials for the film include polyolefins such as homopolymers or copolymers of ethylene or propylene, polyester films, such as those provided under the trade name Mylar™, acrylic polymers, cellulosic polymers, polystyrene, polycarbonate, and vinyl chloride polymers. The wrapper 30 is transparent so that a consumer is able to read the underlying label. It should be understood by those skilled in this art that a transparent wrapper includes both clear and colored wrappers that permit visual inspection of the underlying label. The wrapper 30 of the illustrated embodiment is formed of a heat-shrinkable polyvinylchloride film 50 microns in thickness.

The portion of the wrapper lower portion 36 that overlies the label 20 is adhered thereto with an adhesive layer 24 (FIG. 4). The adhesive should bond to the wrapper 30 and the label 20 with sufficient peel and tensile strength that lifting of portion of the wrapper 30 overlying the label 20 causes the label. 20, rather than either of the aforementioned adhesive bonds, to rupture. The adhesive comprising the adhesive layer 24 is preferably clear to permit visual inspection of the underlying label 20 and heat-activated so that it can bond to the label 20 and the wrapper 30 during the heat-shrinking of the wrapper 30 onto the bottle 14 and cap 12. The adhesive can be formed into a pattern of warning indicia, with the result that removal of the portion of the wrapper 30 overlying the label 20 causes the indicia formed by the adhesive to become visible. For example, the adhesive may be applied to spell out "VOID" or "WARNING" or to form a known warning symbol or icon, such as skull and crossbones. An indicia-forming adhesive layer 24 is particularly preferred when used in conjunction with a label 20 comprising visually distinctive top and inner layers.

Although the label 20 and the wrapper 30 are illustratively and preferably adhesively connected, those skilled in this art will appreciate that any means for securing the label 20 to the wrapper 30 that will cause the label 20 to rupture upon lifting of the portion of the wrapper 30 overlying the label 20 is suitable for use with this invention. An exemplary alternative connection between the label 20 and the wrapper 30 can be formed if a rough and porous label is employed. Portions of the wrapper 30 would flow into crevices located in the label 20 during and after heat-shrinking and form a mechanical joint therebetween. Removal of the wrapper 30 would, then rupture the label 20.

Figure 2:
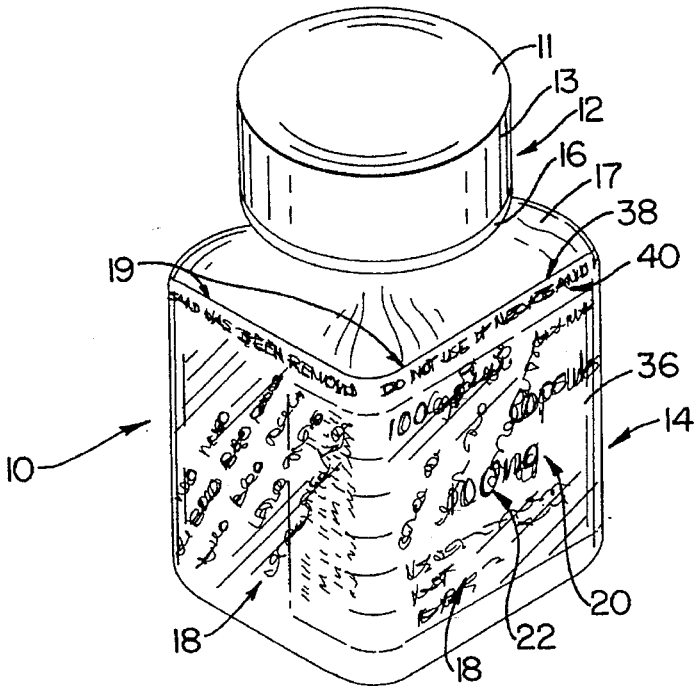
FIG. 2 is a perspective view of a container which has the upper portion of the encasing wrapper removed.
Figure 3:
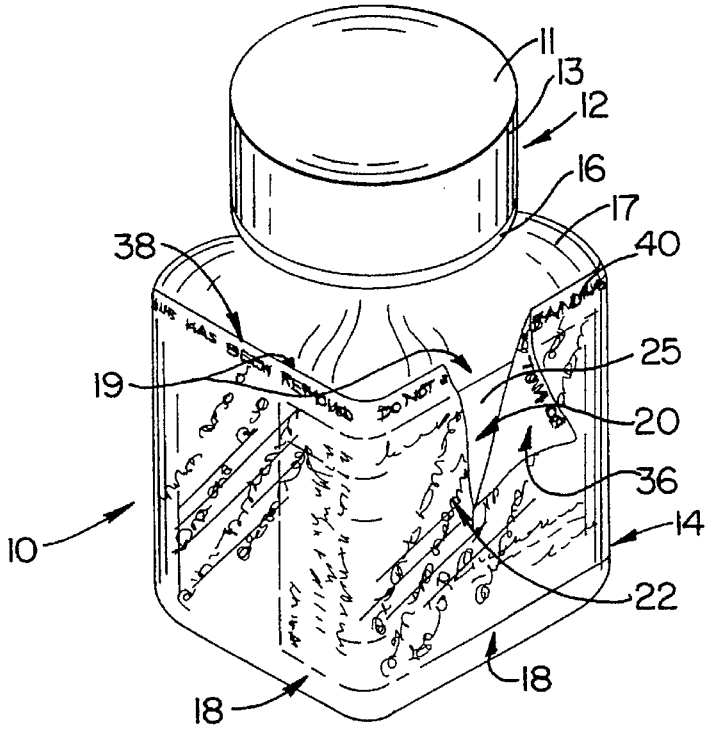
FIG. 3 is a perspective view of a container which shows rupture of the label due to removal of the lower portion of the wrapper.

The tamper-evident nature of the container 10 becomes apparent upon examination of FIGS. 1–3. FIG. 1 shows a container 10 prior to use. A consumer can easily remove the wrapper upper portion 32 by applying a outwardly-directed radial force to the frangible tab 35. Removal of the tab 35, which fractures along perforations 33, 34, exposes the edges of the wrapper upper portion 32. The remainder of the upper portion 32 can then be removed by the application of a radially outwardly directed force to one of these exposed edges, which causes the wrapper upper portion 32 to fracture from the wrapper lower portion 36 along latitudinal perforations 38.

Once the entire wrapper upper portion 32 has been removed, the container 10 has the configuration shown in FIG. 2; this is the typical configuration the container 10 will take for conventional consumer use. In this configuration, the cap 12 can be removed and the interior cavity of the bottle 14 can be accessed. The label 20 remains intact, thereby providing an attractive package for the consumer and enabling the consumer to identify the product and read any instructions written thereon. In addition, the warning text 40 is not defaced and thus is legible to the consumer. As a result, the consumer is warned of the potential for tampering if the wrapper upper portion 32 is removed prior to the consumer's use of the container 10.

FIG. 3 illustrates another feature of the container 10 that can evidence tampering. If someone tampering with the container 10 were to remove a portion of the wrapper lower portion 36 and therefore lift the portion of the wrapper lower portion overlying the label 20, the connection between the wrapper lower portion 36 and the label 20 provided by the adhesive layer 24 causes the label 20 to rupture. Virtually any disturbance of the connection between the label 20 and the wrapper lower portion 36 can cause the label 20 to rupture; thus those skilled in this art should understand that, as used herein, "removal" of the portion of the wrapper lower portion 36 overlying the label 20 is intended to encompass any movement of the wrapper lower portion 36 relative to the label 20, including sliding motion, lifting, twisting, and any combination thereof. Defacement of the label 20 indicates that the container 10 has been tampered with, and in the preferred embodiment, removal of the wrapper lower portion 36 generates a visible warning of possible tampering. As a result, even if the tamperer reapplies a second wrapper 36 in an attempt to conceal the tampering, the defaced label 20 continues to indicate that tampering has occurred.

The foregoing embodiment is illustrative of the present invention, and is not to be construed as limiting thereof. The invention is defined by the following claims, with equivalents of the claims to be included therein.

That which is claimed is:

1. A sealed tamper-evident container, comprising:

a bottle having a side wall portion and an open mouth portion;

a cap connected to said bottle mouth portion;

a frangible label connected to said bottle side wall portion;

a wrapper having an upper portion and a lower portion, with said upper portion overlying said cap and said lower portion overlying said bottle so that said cap is sealably fixed to said bottle, and with said wrapper lower portion overlying at least a portion of said label, said wrapper upper portion being removable from said container and said cap so that said cap can be separated from said container; and means for securing said wrapper lower portion with said frangible label, whereby removal of said wrapper lower portion ruptures said frangible label, said rupture serving as a visible indicia of the removal of said wrapper bottom portion therefrom.

2. A container according to claim 1, wherein said wrapper is transparent.

3. A container according to claim 1, wherein said means for securing said wrapper lower portion to said label comprises a transparent and adhesive layer.

4. A container according to claim 1, wherein said label comprises a smooth top surface portion and a fibrous inner portion, with said adhesive layer connected to said top surface portion.

5. A container according to claim 1, wherein said adhesive layer is formed in the pattern of a visible indicia of warning, whereby a visible indicia of warning in the pattern of said adhesive layer is formed in said label upon removal of said wrapper bottom portion from said label.

6. A container according to claim 1 further comprising means formed in said wrapper for separating said upper portion from said lower portion so that said cap may be separated from said bottle.

7. A container according to claim 6, wherein said side wall portion of said bottle comprises an upper edge portion, and wherein said separating means comprises a series of perforations overlying said upper edge portion, whereby said wrapper lower portion remains overlying said side wall portion of said bottle upon separation of said cap from said bottle.

8. A container according to claim 6, wherein said means for connecting said wrapper lower portion with said label comprises an adhesive layer positioned between and adhesively connecting said wrapper lower portion and said label.

9. A container according to claim 1, wherein said cap includes a top portion, and wherein said wrapper upper portion comprises a series of perforations overlying said cap and extending diagonally from said top portion to said series of perforations overlying said upper edge portion, whereby the application of torque to said cap results in said wrapper upper portion spiraling in a spring-like action away from said cap.

10. A sealed tamper-evident container, comprising:

a bottle having a side wall portion and an open mouth portion;

a cap connected to said bottle mouth portion;

a frangible label connected to said bottle side wall portion;

a wrapper having an upper portion and a lower portion, with said upper portion overlying said cap and said lower portion overlying said bottle so that said cap is sealably fixed to said bottle, and with said wrapper lower portion overlying at least a portion of said label, said wrapper upper portion being removable from said container and said cap so that said cap can be separated from said container;

means for securing said wrapper lower portion with said frangible label, whereby removal of said wrapper lower portion ruptures said frangible label, said rupture serving as a visible indicia of the removal of said wrapper bottom portion therefrom; and means formed in said wrapper for separating said upper portion from said lower portion so that said cap may be separated from said bottle;

wherein said side wall portion of said bottle comprises an upper edge portion, and wherein said separating means comprises a series of perforations overlying said upper edge portion, whereby said wrapper lower portion remains overlying said side wall portion of said bottle upon separation of said cap from said bottle;

and wherein said means for connecting said wrapper lower portion with said label comprises an adhesive layer positioned between and adhesively connecting said wrapper lower portion and said label.

11. A container according to claim 10, wherein said wrapper is transparent.

12. A container according to claim 10, wherein said means for securing said wrapper lower portion to said label comprises a transparent and adhesive layer.

13. A container according to claim 10, wherein said label comprises a smooth top surface portion and a fibrous inner portion, with said adhesive layer connected to said top surface portion.

14. A container according to claim 10, wherein said adhesive layer is formed in the pattern of a visible indicia of warning, whereby a visible indicia of warning in the pattern of said adhesive layer is formed in said label upon removal of said wrapper bottom portion from said label.

15. A container according to claim 10, wherein said cap includes a top portion, and wherein said wrapper upper portion comprises a series of perforations overlying said cap and extending diagonally from said top portion to said series of perforations overlying said upper edge portion, whereby the application of torque to said cap results in said wrapper upper portion spiraling in a spring-like action away from said cap.

* * * * *

UNITED STATES PATENT AND TRADEMARK OFFICE

CERTIFICATE OF CORRECTION

PATENT NO. : 5,495,944

DATED : 05 March 1996

INVENTOR(S) : Stephen C. Lermer

It is certified that error appears in the above-identified patent and that said Letters Patent is hereby corrected as shown below:

Column 2, line 35, please add -- 16 -- after portion.

Column 2, line 40, please add -- 18 -- after walls.

Column 2, line 47, please add -- 11 -- after surface.

Column 2, line 59, please add -- 22 -- after copy.

Column 2, line 65, please add -- 18 -- after walls.

Column 4, line 8, please delete -- . -- after label.

Signed and Sealed this

Sixth Day of August, 1996

Bruce Lehman

*Attest:*

BRUCE LEHMAN

*Attesting Officer*

*Commissioner of Patents and Trademarks*